United States Patent [19]

Barth et al.

[11] 4,435,627

[45] Mar. 6, 1984

[54] HIGH TENSION CIRCUIT BREAKER

[75] Inventors: Not-Duri Barth, Oberehrendingen; Osvin Gaupp, Wettingen, both of Switzerland

[73] Assignee: BBC Brown, Boveri & Company, Limited, Baden, Switzerland

[21] Appl. No.: 282,597

[22] Filed: Jul. 13, 1981

[30] Foreign Application Priority Data

Jul. 18, 1980 [CH] Switzerland ..... 5512/80

[51] Int. Cl.[3] ..... H01H 33/59

[52] U.S. Cl. ..... 200/148 R; 200/146 R; 200/245; 200/250; 200/290; 200/153 K

[58] Field of Search ..... 200/148 R, 148 G, 148 A, 200/245, 248, 250, 251, 287, 290, 153 K, 146 R

[56] References Cited

U.S. PATENT DOCUMENTS 2,727,964 12/1955 Krenke ..... 200/153 K 3,811,022 5/1974 Guidosh ..... 200/153 K

FOREIGN PATENT DOCUMENTS 2708546 1/1980 Fed. Rep. of Germany ... 200/148 R

*Primary Examiner*—Robert S. Macon

*Attorney, Agent, or Firm*—Oblon, Fisher, Spivak, McClelland & Maier

[57] ABSTRACT

A high tension circuit breaker which includes a stationary switching mechanism, a second switching mechanism axially movable in a first axial direction, a first and second arcing contact operatively connected to the movable switching mechanism and a stationary switching mechanism, respectively, wherein the first contact normally pressingly engages the second contact, a supply for gas under pressure, a nozzle communicating with the gas supply formed in the movable contact and terminating adjacent the first and second contact for communicating expanded gas from the gas supply to the point of pressing engagement of the first and second contact upon cutting out of the gas supply for shifting of the second contact in a second axial direction opposite the first axial direction of movement of the movable switching mechanism upon cutting out of the gas supply.

7 Claims, 3 Drawing Figures

HIGH TENSION CIRCUIT BREAKER

BACKGROUND OF THE INVENTION

1. Field of the Invention

The invention concerns a high tension circuit breaker.

2. Description of the Prior Art

A high tension circuit breaker is known from the German Publication 27 08 546. With this circuit breaker, short electric arc periods are achieved until the arc quenching distance is reached by means of rapid relaxation of the force of a pressure spring, the arcing or burn-up portion of the movable contact being under the effect of the basing force of this pressure spring in the on-position of the circuit breaker. However, a releasing device is necessary for this purpose by means of which the movable arcing portion is released after the preliminary compression phase. It is, however, difficult to attach a reliable and reproduceably functioning release system in the area of the arcing portion.

It is therefore an object of the invention to create a high tension circuit breaker of the kind where a high separation velocity of the arcing contacts is achieved and, thus, a short cut-off period is attained without using a releasing device.

The circuit breaker according to the invention is characterized by the fact that it is structurally simple and that a fast separation of the arcing or burn-up contacts is effected in the cut-off plase owing to the use of two drives acting in opposite directions on the arcing portions.

The design of the high tension circuit breaker of the present invention has proven to be very favorable insofar as the total amount of energy of a loaded energy storage is available at the moment of contact separation whereby the arcing portion of the stationary contact is greatly accelerated after the contact separation and, thus, an extremely high separation velocity is attained.

The embodiment of the circuit breaker of the invention can be applied to circuit breakers, which have proven to be reliable in practice, without extensive structural changes and has the additional advantage that the force occurring through friction contact with an overlapping tripping pin increases the effect of releasing of the spring, and thus, increases the separation velocity of the arcing contacts. The present invention also distinguishes itself especially by the fact that the energy of the expanding quenching gases developing with cutting-out can be utilized by using a simple mechanical mechanism.

In the present invention, a high separation velocity is also achieved without any essential mechanical interventions on the arcing portions since the drive of the arcing portion of the stationary contact is essentially effected through an electrical system.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
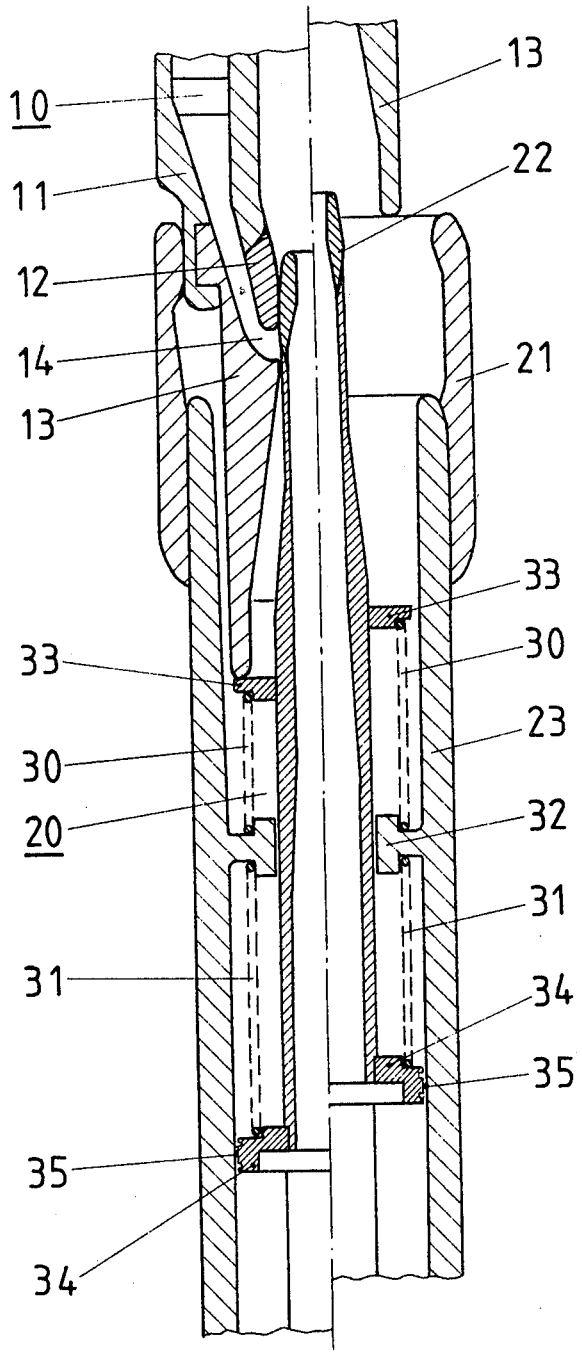
FIG. 1 is a top view of a cross-section of a first embodiment of the high tension circuit breaker according to the present invention where the arcing contact of the stationary switching mechanism is supported in a vibratory manner in the cut-in position.
Figure 2:
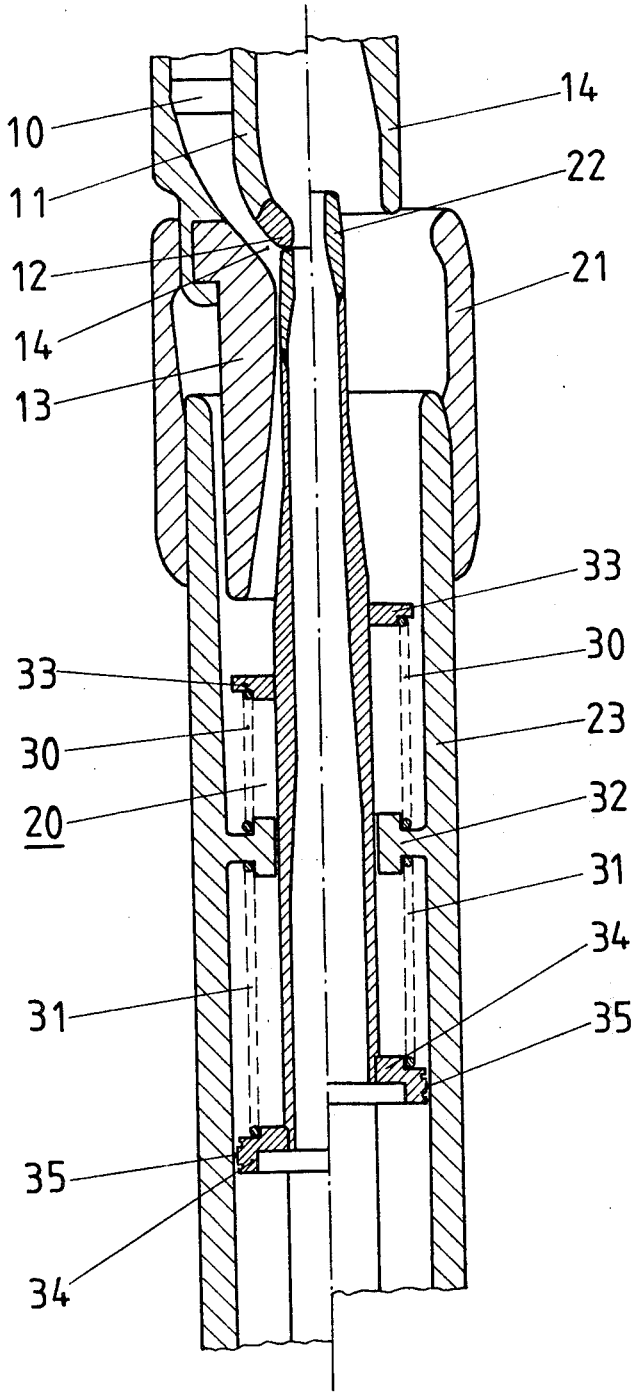
FIG. 2 is a top view of a cross-section through a second embodiment where the arcing contacts are in frontal contact with each other in the cut-in position in contrast to the first embodiment shown in FIG. 1.
Figure 3:
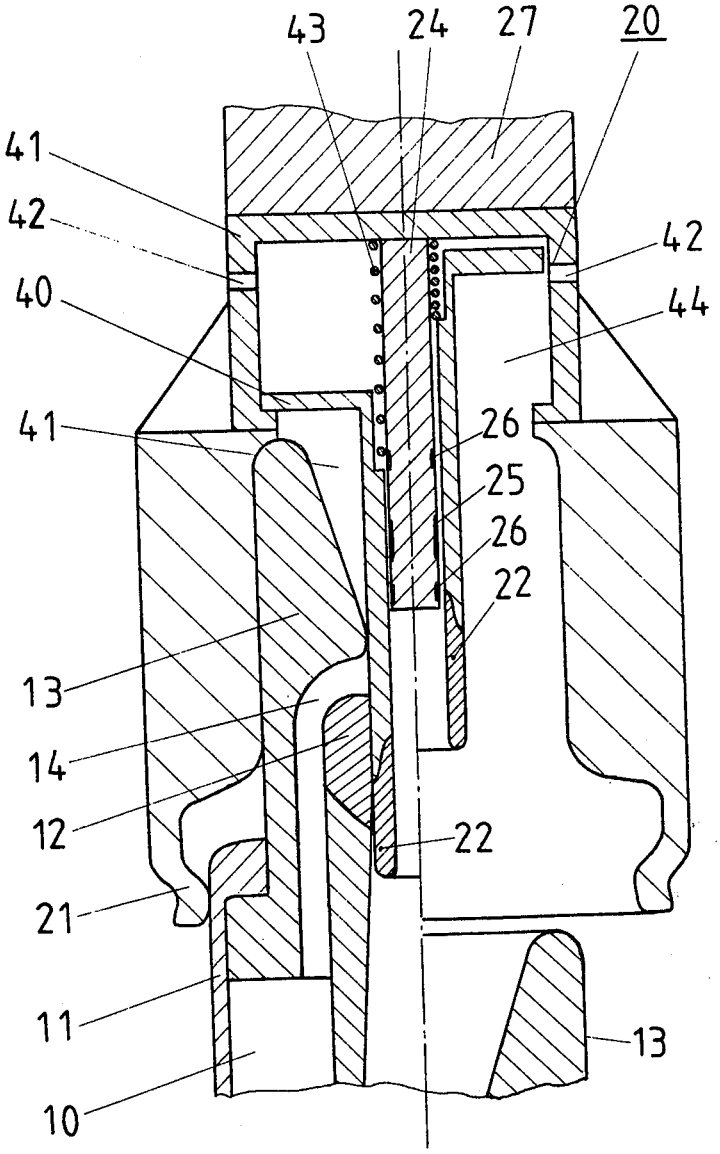
FIG. 3 is a top view of a cross-section of a third embodiment of the high tension circuit breaker according to the present invention where the arcing contact of the stationary switching mechanism is driven by the expanding gases developing with cutting out.

In each of FIGS. 1–3, the respective cut-in position of the circuit breaker is indicated in the left portion thereof and the respective cut-out position in the right portion thereof. A movable switching mechanism 10 and a stationary switching mechanism 20 of a high tension circuit breaker are shown in FIG. 1.

Movable switching mechanism 10 has a rated current contact 11 and a burn-up or arcing contact 22. Rated current contact 11 of movable contact 10 is connected with a nozzle 13 of insulating material which forms a blow duct 14 with arcing contact 12 through which, with cutting-out of a compression system whose movable part e.g., a piston or a cylinder, is connected with movable contact 10. Gas under pressure is communicated into the separation distance between arcing contacts 12 and 22. Arcing contact 22 of stationary switching mechanism 20 rests in pressing engagement in the direction of the switching mechanism axis against a rated current contact carrier 23 in the cut-out position (i.e., right portion of FIG. 1). In this instance, fusable contact 22 is supported by two springs 30, 31 arranged in staggered fashion in the direction of the tripping pin axis. Springs 30, 31 rest with their ends turned towards each other on a stop 32 of the rated current contact carrier 23 and with their ends turned away from each other on stops 33, 34 of arcing contact 22. Contact laminations 35 provide electrical connection between contact 22 or stop 34 and rated current contact carrier 23.

The mode of operation of the high tension circuit breaker according to the present invention will now be described. In the cut-in position (i.e., portion of FIG. 1), nozzle 13 of insulating material presses on stop 33 and displaces contact 22 of stationary contact 20 out of its normal position of equilibrium. Potential energy is thus stored in springs 30, 31. Upon cutting out, movable contact 10 is rapidly accelerated in an upward direction. Contact 22 which is biased by charged springs 30, 31 follows movable contact 10 beyond its position of equilibrium owing to its inertia and owing to the overlapping of the tripping pin of the two hollow contacts 12, 22. In this manner, the preliminary compression phase of the quenching gas initiated with the beginning of the movement of the movable contact 10 is extended.

As soon as contacts 12, 22 are separated from each other, a cut-out arc (not shown) is drawn, and at the same, intensive blowing of the arc with quencher gas occurs from blow duct 14. Additionally, springs 30, 31 are again charged with potential energy at the point in time of the contact separation and an acceleration force is now exerted on contact 22 of stationary switching mechanism 20 directed opposite to the movement of movable switching mechanism 10. Contact 22 is moved back beyond the position of equilibrium by means of the force of springs 30, 31. In this manner, the separation velocity of contacts 12, 22 is increased in comparison with the separation velocity of the circuit breakers in which a stationary contact is provided and the cut-out contact rating is improved due to the fact that the necessary quenching distance is reached more quickly.

It is preferably to highly dampen the oscillatory system which includes contact 22, rated current contact carrier 23 and springs 30, 31—possibly with contact laminations 35. In this instance, the dampening effect in the embodiment according to FIG. 1 is compensated for by the friction contact between hollow contacts 12, 22 as well as by the repulsive forces occurring with the return thereof. As to the embodiment according to FIG. 2 where contacts 12, 22 contact the front side portion of each other in the cut-in position and tighten springs 30, 31 instead of nozzle 13 of insulating material, it is preferably to dampen the vibratory system generally somewhat less.

The third embodiment of the circuit breaker according to the present invention is shown in FIG. 3. In this case, reference number 24 refers to a guide bolt provided with contact laminations 25 and scraper rings 26 on which fusable contact 22 of stationary switching mechanism 20 can slide in an axial direction to a current connection 27 of stationary switching mechanism 20. Contact 22 has a ring piston 40 sliding in a cylinder 41 on its side away from the switching route.

Piston 40 and cylinder 41 form a pneumatic drive for contact 22. The quencher gas which expands with the cutting-out is provided, in this instance, as the operating mechanism and is led into a compression space 44 of the pneumatic drive. On the side of piston 40 away from compression space 44, a return spring 43 is provided. Furthermore, the jacket surface of the cylinder 41 has openings 42 formed therein through which the expanding quencher gases can escape before piston 40 has reached its final position in cylinder 41.

The mode of operation of this third embodiment of the high tension circuit breaker according to the present invention will now be described. With cutting-out, switching mechanism, 10 is moved downward. First of all, rated current contacts 11, 21 are opened and the current to be cut off is connected to contacts 12, 22. At the same time, quencher gas is subjected to a preliminary compression in the compression system (not shown). As soon as the switching mechanism overlapping of contacts 12, 22 is eliminated, a cut-out arc (not shown) is drawn, and at the same time, intensive blowing of the arc occurs with quencher gas from the duct 14. The quencher gas expands past the hollow contact 12 provided with a nozzle-shaped opening as well as through the opening of nozzle 13 into pressure space 44 of the pneumatic drive. Piston 40 and thus contact 22 are now accelerated into the opposite direction of movement of movable switching mechanism 10 whereby movement at a high velocity is achieved between contacts 12, 22. Just before reaching the final position, piston 40 frees the openings 42 through which the expanding pressure gases can now escape from cylinder 41.

A spring 43 handles the dampening of contact 22. After quenching of the arc and after the dampening of the effect of the force on piston 40 occurs, spring 43 controls return of contact 22. The maximum displacement of contact 22 is selected in such a manner that, in the course of the cut-in movement of the circuit breaker, contact of the contacts 12, 22 is always effected before contact of rated current contacts 11, 21 which means that the displacement is selected in such a way in cylinder 41 that, with the impact of piston 40 on the bottom of cylinder 41, contact 22 is pushed into engagement with contact 12. In this instance, contact laminations 25 effect the current transfer from contact 22 on guide bolt 24. Contact laminations 25 are protected against contamination by means of scraper rings 26.

The object of the invention is not restricted to what is represented in the drawing and thus it could be considered to design the ring piston 40 in the exemplified embodiment according to FIG. 3 as a short-circuiting ring and to provide a cylindrical coil coaxially to this ring and to the contact instead of the cylinder of a pneumatic drive, with the short-circuiting ring and thus the contact 22 being displaceable on the cylindrical axis of the cylindrical coil. This coil is only connected to the current so as to be cut off after separation of rated current contacts 11, 21. The magnetic field produced by the current (flowing through the coil) exerts a force on the short-circuiting ring which accelerates the short-circuiting ring and thus contact 22 in opposition to movement of switching mechanism 10. A very high separation velocity of contacts 12, 22 is also achieved in this manner.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high tension circuit breaker comprising:

a stationary first switching mechanism;

a second switching mechanism axially movable in a first axial direction;

a first and second arcing contact operatively connected to said movable switching mechanism and said stationary switching mechanism, respectively, and wherein said first contact normally pressingly engages said second contact;

means for supplying gas under pressure;

nozzle means communicating with said gas supply means formed in said movable switch mechanism and terminating adjacent said first and second contacts for communicating expanded gas from said supply gas to the point of pressing engagement of said first and second contact upon cutting out of said gas supply means wherein said nozzle means comprises insulation material; and means for shifting said second contact in a second axial direction opposite said first axial direction of movement of said movable switching mechanism upon cutting out of said gas supply means.

2. A high tension circuit breaker as set forth in claim 1, further comprising:

a rated current contact carrier member having a first stop member radially inwardly projecting therefrom;

a second and third stop member mounted on said second arcing contact; and biasing means comprising a first and second spring mounted in said contact carrier operatively engaging said stationary switching mechanism and disposed between said first and second stop member and said first and second stop member, respectively.

3. A high tension circuit breaker as set forth in claim 1 or 2, wherein said first and second contacts include a hollow central portion and comprise an overlapping switch mechanism under normal conditions.

4. A high tension circuit breaker as set forth in claims 1 or 2, wherein said first and second contact each further comprise front side portions normally in pressing engagement.

5. A high tension circuit breaker as set forth in claim 1, further comprising pneumatic means connected to said second contact and forming an interior space into which at least a portion of said expanded gas is communicated upon movement of said movable switching mechanism in said first axial direction and upon separation of said first and second contacts.

6. A high tension circuit breaker as set forth in claim 5, wherein sad pneumatic drive means further comprises a cylinder, a piston mounted in said cylinder, and biasing means positioned in said cylinder or axially biasing said first and second contacts into pressing engagement;

said cylinder having an opening formed therein for allowing escape of said expanded gas upon cutting out of said gas supply means.

7. A high tension circuit breaker as set forth in claim 1, further comprising first and second rated contact carriers wherein said first contact further comprises a coil and short-circuiting ring member mounted in said coil and coaxially surrounding the first contact and through which at least a portion of a cut-off current flows after separation of said first and second contact carriers.

* * * * *